US010870093B1

(12) United States Patent
Zhong et al.

(10) Patent No.: US 10,870,093 B1
(45) Date of Patent: Dec. 22, 2020

(54) MULTIFUNCTIONAL BLENDING EQUIPMENT

(71) Applicant: YANTAI JEREH PETROLEUM EQUIPMENT & TECHNOLOGIES CO., LTD., Yantai (CN)

(72) Inventors: Jifeng Zhong, Yantai (CN); Weiwei Liu, Yantai (CN); Kun Zhang, Yantai (CN); Xincheng Li, Yantai (CN); Jixin Wang, Yantai (CN); Yipeng Wu, Yantai (CN); Sheng Chang, Yantai (CN); Bingnan Lv, Yantai (CN); Shuwei Li, Yantai (CN); Chuanlu Bao, Yantai (CN)

(73) Assignee: Yantai Jereh Petroleum Equipment & Technologies Co., Ltd., Yantai (CN)

( * ) Notice: Subject to any disclaimer, the term of this patent is extended or adjusted under 35 U.S.C. 154(b) by 0 days.

(21) Appl. No.: 16/837,096

(22) Filed: Apr. 1, 2020

(30) Foreign Application Priority Data

Jun. 21, 2019 (CN) ..... 2019 1 0540695

(51) Int. Cl.
*B01F 13/10* (2006.01)

(52) U.S. Cl.
CPC ..... *B01F 13/1013* (2013.01)

(58) Field of Classification Search
CPC ..... B01F 13/1013
USPC ..... 366/163.2, 177.1, 182.2
See application file for complete search history.

(56) References Cited

U.S. PATENT DOCUMENTS

2005/0024988 A1* 2/2005 Hoff ..... B01F 15/00032 366/141

* cited by examiner

*Primary Examiner* — David L Sorkin

(57) ABSTRACT

The present invention discloses multifunctional blending equipment, including a clear water supply system, an injection system, more than two mixing systems, more than two powder storage and delivery systems, a mixing tank, a discharge system, and an electrical control system. One path of the clear water supply system is piped into the mixing tank, and another path of the clear water supply system is connected to the input end of the infection system. An output end of the injection system is connected in parallel with more than two mixing systems. The number of the powder storage and delivery systems is equal to that of the mixing systems. Each powder storage and delivery system is correspondingly connected to one mixing system. Output ends of the more than two mixing systems are all connected into the mixing tank. An output end of the mixing tank is connected to the discharge system. The clear water supply system, the injection system, the mixing systems, the powder storage and delivery systems, the mixing tank, and the discharge system are controlled by the electrical control system. Beneficial effects: The blending equipment can implement various blending processes at the same time, which is integrally skid mounted, and occupies small space.

10 Claims, 1 Drawing Sheet

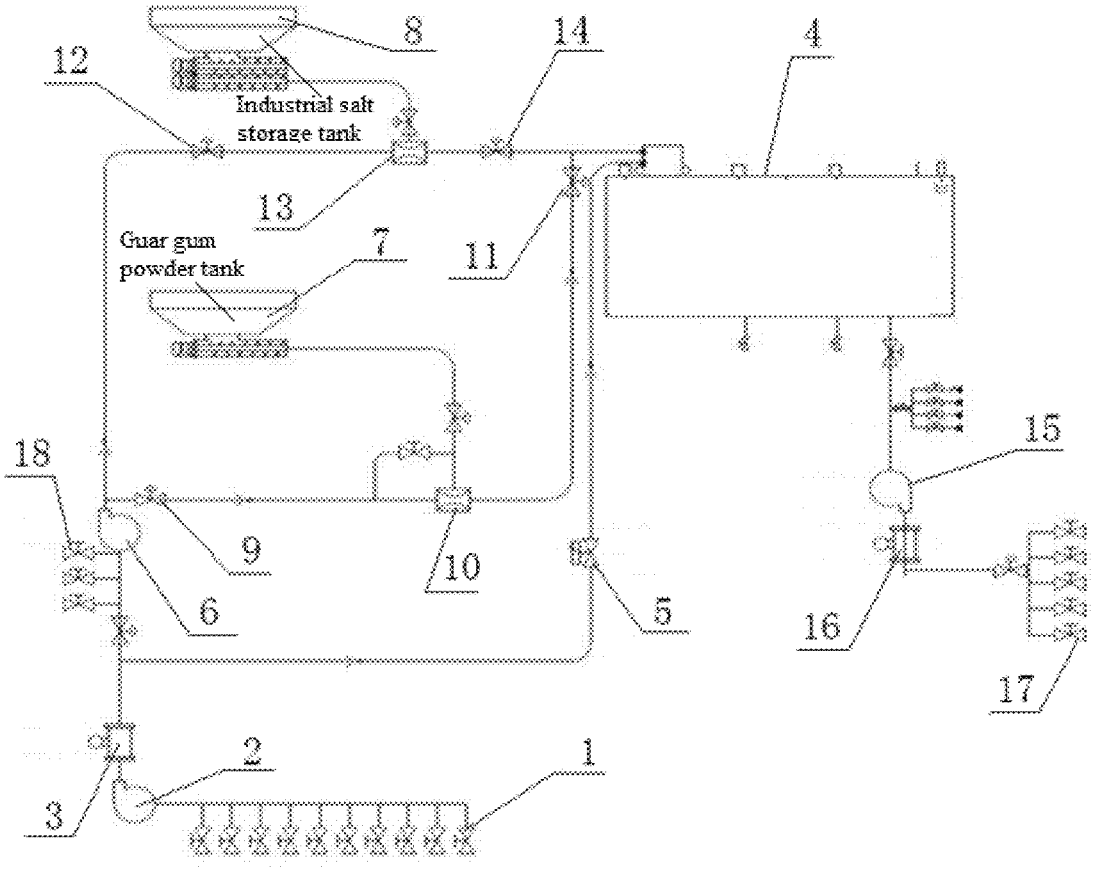
8
14
4
12
Industrial salt
storage tank
13
Guar gum
powder tank
7
11
15
18
9
10
6
5
16
17
2
1
3

MULTIFUNCTIONAL BLENDING EQUIPMENT

TECHNICAL FIELD

The present invention relates to the technical field of fracturing in oil and gas fields, and specifically relates to multifunctional blending equipment.

BACKGROUND

Well drilling is an indispensable process in oil exploration nowadays. Drilling fluid and flushing fluid are commonly used in drilling. At present, the two fluids are mostly prepared at fixed stations. Fracturing is a major approach to increase the production of oil and gas fields. Currently, a large amount of fracturing base fluid is required in the fracturing operations all over the world, especially the fracturing sites of shale gas. A lot of base fluid is still prepared at fixed sites in China. The preparation sites of the two fluids occupy a large area, require a lot of staff, and are inadequately automated. Based on the above requirements, the present invention provides a set of multifunctional fluid formulation equipment, which can prepare a variety of fluids and is widely applicable, thereby resolving problems such as large occupied area and inadequate automation, during the fluid preparation at fixed sites. The equipment may be operated to replace the original operations at fixed sites, and can be used to prepare fluid in real time at the drilling or fracturing sites. The equipment may be used to match the driving forms such as diesel drive, an electro-hydraulic drive and electric drive according to various operation requirements and different matching capabilities of on-site electricity to adapt to the requirements at different well sites. The equipment has a compact structure to facilitate the delivery and transfer. Based on the foregoing characteristics, the equipment of the invention can effectively solve various problems of fluid preparation at fixed sites.

SUMMARY

To overcome deficiencies in the prior art, an objective of the present invention is to provide multifunctional blending equipment. In the blending equipment, more than two mixing systems are connected in parallel, and each mixing system is equipped with an individual powder feeding system. One or two or several mixing systems are selectively initiated to achieve separate blending of one kind of fluid or simultaneous blending of various fluids. On this basis, the two ends of the blending equipment are selectively connected to downstream equipment or a storage tank to achieve real-time blending or batch blending. The blending equipment is integrally skid mounted, easy to move and occupies small space.

The objective of the present invention is achieved by the following technical solution: Multifunctional blending equipment includes a clear water supply system, an injection system, more than two mixing systems, more than two powder storage and delivery systems, a mixing tank, a discharge system, and an electrical control system. One path of the clear water supply system is piped into the mixing tank, and another path of the clear water supply system is connected to an input end of the injection system. An output end of the injection system is connected in parallel with more than two mixing systems. The number of the powder material storage and delivery systems is equal to that of the mixing systems, each powder material storage and delivery system is correspondingly connected to one mixing system. Output ends of the more than two mixing systems are all connected into the mixing tank. An output end of the mixing tank is connected to the discharge system. The clear water supply system, the injection system, the mixing systems, the powder storage and delivery systems, the mixing tank, and the discharge system are controlled by the electrical control system.

Further, the multifunctional blending equipment is driven electrically or/and electro-hydraulically or/and driven by engine.

Further, the multifunctional blending equipment further includes a liquid one or more replenishing valves, the replenishing valves are connected in parallel with the clear water supply system, and the replenishing valves are connected to the injection system.

Further, the clear water supply system, the injection system, the mixing systems, the powder material storage and delivery systems, the mixing tank, the discharge system, and the electrical control system are integrally skid mounted on a skid base.

Further, the multifunctional blending equipment is further provided with a folding crane configured for adding powder materials, and the folding crane is skid mounted on the skid base.

Further, the corresponding metering devices are set according to the different powder materials added.

Further, the clear water supply system includes multiple clear water valves, a suction pump, and a flow meter, and the clear water valves, the suction pump, and the flow meter are connected successively and then connected into the mixing tank and the injection system respectively.

Further, the clear water supply system further includes a level control valve, and the level control valve is located on the pipeline directly connected with the mixing tank.

Further, the type of the mixers in the mixing systems is selected according to the characteristics of the powder materials added.

Further, when large granular powders are added through the powder storage and delivery system.

Compared with the prior art, beneficial effects of the present invention are as below: 1. In the blending equipment, more than two mixing systems are connected in parallel, and each mixing system is equipped with an individual powder feeding system. One or two or several mixing systems are selectively initiated to achieve separate blending of one kind of fluid or simultaneous blending of various fluids. On this basis, the two ends of the blending equipment are selectively connected to downstream equipment or a storage tank to achieve real-time blending or batch blending. 2. The blending equipment may drive related execution components electrically or/and electro-hydraulically or/and driven by engine, which is much more energy efficient and environmentally friendly than the original case in which they were driven only by engine, thereby reducing exhaust emission and operation costs. 3. The blending equipment is integrally skid mounted, easy to move and occupies small space. 4. In the blending equipment, the number and type of mixers may be flexibly set to meet the requirements of various blending processes.

The present invention will be described below in detail with reference to the accompanying drawings and specific implementations.

BRIEF DESCRIPTION OF THE DRAWINGS

FIG. 1 is a process flowchart of the multifunctional blending equipment according to an embodiment of the invention.

Where: 1. clear water valve, 2. suction pump, 3. flow meter, 4. mixing tank, 5. level control valve, 6. injection pump, 7. guar gum powder storage and delivery system, 8. industrial salt storage and delivery system, 9. valve, 10. first mixer, 11. valve, 12. valve, 13. second mixer, 14. valve, 15. discharge pump, 16. flow meter, 17. valve, and 18. replenishing valve.

DESCRIPTION OF THE EMBODIMENTS

As shown in FIG. 1, multifunctional blending equipment includes a clear water supply system, an injection system, more than two mixing systems, more than two powder storage and delivery systems, a mixing tank 4, a discharge system, a folding crane, and an electrical control system. One path of the clear water supply system is piped into the mixing tank 4, and another path of the clear water supply system is connected to an input end of the injection system. An output end of the injection system is connected in parallel with more than two mixing systems. The number of the powder storage and delivery systems is equal to that of the mixing systems. Each powder storage and delivery system is correspondingly connected to one mixing system. Output ends of the more than two mixing systems are all connected into the mixing tank 4. An output end of the mixing tank 4 is connected to the discharge system. The folding crane is configured for adding powder to the powder material storage and delivery system. When the powder is used up in the powder storage and delivery system, the time and manpower needed to add a large amount of powder can be greatly saved by the folding crane. The clear water supply system, the injection system, the mixing systems, the powder storage and delivery systems, the mixing tank 4, and the discharge system are controlled by the electrical control system, and is driven electrically or/and electro-hydraulically or/and driven by engine. The purely electric drive blending and supplying equipment of the blending equipment can adequately meet the electrical requirements of operation equipment at the well sites. Compared with the traditional equipment driven by engine, the electric drive equipment is more energy efficient and environmentally friendly, thereby reducing fuel consumption and exhaust emission. The clear water supply system, the infection system, the mixing systems, the powder material storage and delivery systems, the mixing tank 4, the folding crane, the discharge system, and the electrical control system are integrally skid 20 mounted on a skid base. Multiple mixing systems and the powder material storage and delivery systems corresponding to the mixing systems can meet the requirements of various blending processes. Valves are provided at each of the input and output ends of the mixers in each mixing system. The mixing system can be specifically switched on and off by adjusting the valves at the input and output ends.

According to the conditions of materials, necessary pretreatment equipment can be arranged in the powder material storage and delivery system, such as a crusher for large granular salts configured to crush large-size materials into small-size materials, to facilitate the subsequent mixing process.

When blending different powder materials, corresponding metering devices shall be set for different powder. For example, the delivering amount can be measured by rotational speed, or can be measured with the assistance of an electronic scale.

The clear water supply system includes multiple clear water valves 1, a suction pump 2, and a flow meter 3. The clear water valves 1, the suction pump 2, and the flow meter 3 are connected successively and then connected into the mixing tank 4 and the injection system respectively. There are multiple clear water valves 1 to meet the a requirement of rapidly delivering clear water during blending. The level control valve 5 arranged on the pipeline and directly connected to the mixing tank 4 can control a the delivering amount of clear water.

The injection system includes an inlet valve and an injection pump 6. The inlet valve is used to control the on or off of the injection system and connected with the injection pump 6 in series.

The multifunctional blending equipment further includes one or more replenishing valves 18. The replenishing valves 18 are connected in parallel with the clear water supply system. The replenishing valves 18 are connected to the injection pump 6.

The powder storage and delivery system includes a guar gum powder storage and delivery system 7, an industrial salt storage and delivery system 8, and the like, to meet the operation requirements on the preparation of fracturing fluid, workover fluid and flushing fluid at the well sites.

The mixing systems include a guar gum mixing system, an industrial salt mixing system, and the like. The guar gum powder storage and delivery system 7 is connected to the guar gum mixing system. The industrial salt mixing system is connected to the industrial salt storage and delivery system 8. The guar gum mixing system includes a valve 9, a first mixer 10, and a valve 11. The valve 9, the first mixer 10, and the valve 11 are connected successively. The valve 9 is connected to the injection pump 6. The valve 11 is connected to the mixing tank 4. The industrial salt mixing system includes a valve 12, a second mixer 13, and a valve 14. The valve 12 is connected to the injection pump 6. The valve 14 is connected to the mixing tank 4. The type of the first mixer 10 and the second mixer 13 is set according to the properties of powder added to increase the compatibility between the mixer and the powder and mix the powder more adequately.

The discharge system includes a discharge pump 15, a flow meter 16, and multiple valves 17. The discharge pump 15, the flow meter 16, and the valves 17 are connected successively.

The electrical control system includes a frequency conversion cabinet and a control cabinet.

The multifunctional blending equipment further includes a liquid adding system. The liquid adding system is connected to the suction pump 2 or the discharge pump 15. When liquid ingredients need to be added, they are added via the liquid adding system.

Embodiment 1: Individual blending of one ingredient. For example, for blending of guar gum fluid, the clear water source is connected with the clear water valves 1. The industrial salt storage and delivery system 8, the valve 12, the second mixer 13, the valve 14, and the replenishing valves 18 are all switched off, keeping other components of the equipment in working state. One path of the clear water enters the mixing tank 4 through the level control valve 5, and another path of the clear water enters the first mixer 10 through the injection pump 6. The powder is delivered through the guar gum powder storage and delivery system 7 and mixed in the first mixer 10. The mixed fluid is delivered into the mixing tank 4 for further mixing and is finally discharged through the discharge pump 15, the flow meter 16, and the valves 17.

Embodiment 2: Simultaneous blending of various ingredients. For example, for simultaneous blending of guar gum powder and industrial salt, compared with Embodiment 1, the industrial salt storage and delivery system 8, the valve 12, the second mixer 13, and the valve 14 are all switched on to keep normal working. Clear water is injected by the injection pump 6 into the first mixer 10 and the second mixer 13 respectively and premixed with the powder added by the respective guar gum powder storage and delivery system 7 and industrial salt storage and delivery system 8. The mixed fluid flow into the mixing tank 4 together for further mixing, and then discharged through the discharge system.

Alternatively, the valves (the valve 9, the valve 11, the valve 12, and the valve 14) at both ends of the first mixer 10 and the second mixer 13 are all removed. The blending mode is controlled by whether powder is added to the corresponding mixer by the powder storage and delivery system (individual blending or blending of more than two kinds of powder). For example, when individually blending the guar gum, it is only necessary to deliver the powder into the system through the guar gum powder storage and delivery system 7, in which other parts of the mixing systems only deliver the clear water.

When the suction centrifugal pump is in working state, if different liquid needs to be additionally added by the equipment, the liquid may be added through the replenishing valve before the injection system. When the suction centrifugal pump is not in working state, the valve between the injection system and the suction pump can be switched off, so that the injection system can run separately to meet small-flow recycle mixing, thereby reducing the power consumption of the equipment.

In real-time mixing, the inlet and outlet ends of the multifunctional blending equipment are connected to corresponding upstream and downstream equipment. In batch mixing, the inlet and outlet ends of the multifunctional blending equipment are connected to the storage tank to implement the circulation of blending fluid.

What is claimed is:

1. Multifunctional blending equipment, comprising a clear water supply system, an injection system, more than two mixing systems, more than two powder storage and delivery systems, a mixing tank, a discharge system, and an electrical control system, wherein one path of the clear water supply system is piped into the mixing tank, and another path of the clear water supply system is connected to an input end of the injection system; an output end of the injection system is connected in parallel with the more than two mixing systems, the number of the powder storage and delivery systems is equal to that of the mixing systems, each powder storage and delivery system is correspondingly connected to one mixing system, output ends of the more than two mixing systems are all connected into the mixing tank; an output end of the mixing tank is connected to the discharge system, and the clear water supply system, the injection system, the more than mixing systems, the powder storage and delivery systems, the mixing tank, and the discharge system are controlled by the electrical control system.

2. The multifunctional blending equipment according to claim 1, wherein the multifunctional blending equipment is driven electrically or/and electro-hydraulically or/and driven by engine.

3. The multifunctional blending equipment according to claim 1, wherein the multifunctional blending equipment further comprises one or more replenishing valves, the replenishing valves are connected in parallel with the clear water supply system, and the replenishing valves are connected to the injection system.

4. The multifunctional blending equipment according to claim 1, wherein the clear water supply system, the injection system, the mixing system, the powder storage and delivery systems, the mixing tank, the discharge system, and the electrical control system are integrally skid mounted on a skid base.

5. The multifunctional blending equipment according to claim 4, wherein the multifunctional blending equipment is further provided with a folding crane configured for adding powder, and the folding crane is skid mounted on the skid base.

6. The multifunctional blending equipment according to claim 5, wherein corresponding metering devices are set according to the different powder materials added.

7. The multifunctional blending equipment according to claim 1, wherein the clear water supply system comprises multiple clear water valves, a suction pump, and a flow meter, and the clear water valves, the suction pump, and the flow meter are connected successively and separately connected into the mixing tank and the injection system respectively.

8. The multifunctional blending equipment according to claim 7, wherein the clear water supply system further comprises a level control valve, and the level control valve is located on the pipeline directly connected with the mixing tank.

9. The multifunctional blending equipment according to claim 1, wherein the type of the mixers in the mixing systems is selected according to the characteristics of the powders added.

10. The multifunctional blending equipment according to claim 1, wherein when large granular powders are added through the powder storage and delivery system, a crusher can be additionally arranged on the powder storage and delivery system.

* * * * *